US005769726A

United States Patent [19]

Cory

[11] Patent Number: 5,769,726

[45] Date of Patent: Jun. 23, 1998

[54] SPARK GENERATING APPARATUS

[76] Inventor: Philip C. Cory, 10474 Santa Monica Blvd. Suite 305, Los Angeles, Calif. 90025

[21] Appl. No.: 842,265

[22] Filed: Apr. 24, 1997

[51] Int. Cl.[6] ..... A63G 31/00

[52] U.S. Cl. ..... 472/66

[58] Field of Search ..... 472/57, 66, 65; 219/69.11, 69.1, 69.15, 76.13, 121.12

[56] References Cited

U.S. PATENT DOCUMENTS 5,545,092 8/1996 Johnson et al. ..... 472/66

*Primary Examiner*—Kien T. Nguyen
*Attorney, Agent, or Firm*—Michael A. Painter

[57] ABSTRACT

An apparatus for generating sparks over a selected area to be used for theatrical effects. Metal wire having a diameter in the range of 0.020–0.125 inches is provided by two, independent supply sources. Each wire supply source is coupled to a wire guide which imposes synchronous, linear movement to each wire source at a selected rate. Each wire source is coupled to a tip assembly which places the terminus of each wire source adjacent one another. The positive and negative electrodes of a direct current power source are electrically connected to a respective terminus of each of the pair of wire sources, the output of the direct current power source is amplified to voltage sufficient to atomize the wire when the power source is short circuited. The atomization of the wire results in the production of heated, metallic particles simulating generated sparks. A source of compressed air is disposed adjacent the point of atomization. The atomized particles are disseminated across an area determined by the force imposed thereon by the compressed air.

7 Claims, 2 Drawing Sheets

SPARK GENERATING APPARATUS

BACKGROUND OF THE INVENTION

1. Field of the Invention

The present invention generally relates to apparatus used to create theatrical effects and, more particularly to, an apparatus for generating and disseminate sparks over a selected area.

2. Prior Art

With the increasing sophistication of the entertainment industry, the demands of the public now require realistic, special effects. Various devices disclosed by the prior art create special effects in an amusement or theme park setting as well as stage sets used for motion pictures. Known explosion effects have been generated using pyrotechnics or compressed gasses. Underwater special effects are generated by the use of bubbles generated by compressed air or gas and special lighting. However, where special effects are required to simulate electrical discharges in the form of sparks, it is necessary for the effect be repeated or continued on a high duty cycle in order to and create a vivid and realistic effect. Although the prior art does disclose means for simulating explosions and scattering of debris, all fail to resolve the problem necessary to generate sparks for continuous intervals over a selected area in the absence of an external source of electrical power.

The present invention resolves the inadequacies inherent in those devices disclosed in the prior art. The present invention employs a direct current source of power thereby permitting use in remote locations. A pair of wire supply sources are each independently coupled to a wire driving member, each wire driving member providing, synchronous linear movement to the wire at a selected rate. Each wire source is coupled through a tip assembly which places the terminus of each wire source adjacent one another. Positive and negative electrodes of the amplified, direct current power source are respectively connected to one of the wire sources. When the wire sources come in contact with one another, an electrical short circuit is created resulting in the atomization of the wire. A source of compressed air is disposed adjacent the interface between the wire sources. Based upon the selected pressure of the air flow, atomized particles of the metal wire may be disseminated across a predetermined area.

SUMMARY OF THE INVENTION

The present invention provides an apparatus for generating sparks to be used in the creation of theatrical special effects. Sparks are created through the atomization and/or production of superheated metallic particles. A pair of sources of cylindrical wire are provided as the metallic sources. Each wire source is coupled to an independent wire guide and driving member which are in a synchronous relationship to one another. Each wire guide and drive member imparts a linear movement to the wire coupled therethrough.

The wire source being emitted from the wire guide and driving members are coupled through a tip assembly. The tip assembly orients the linearly moving wire sources adjacent one another. A direct current power source having positive and negative electrodes is employed. The output of the power source is amplified to provide high voltage and current outputs at a predetermined duty cycle. The positive and negative electrodes of the power source are each electrically connected to a respective one of the wire sources. A short circuit created by the adjacent wire sources results in an electrical discharge causing in the continuous atomization of metal particles. A source of flowing air is placed in abutment with the interface between the wire sources. The atomized particles are disseminated across an area which is dependent upon the force imposed by the air supply. As a result of the continuous, linear movement of the wire sources, sparks are continuously generated and disseminated over a preselected area.

It is an object of the present invention to provide an improved apparatus for generating sparks to be used for theatrical special effects.

It is another object of the present invention to provide an apparatus for generating sparks over a preselected area.

It is still another object of the present invention to continuously provide a source of sparks for special effects.

It is still yet another object of the present to provide an apparatus for generating sparks for theatrical purposes which is simple and inexpensive to fabricate.

The novel features which are believed to be characteristic of the invention, both as to its organization and method of operation, together with further objectives and advantages thereof, will be better understood from the following description considered in connection with the accompanying drawing in which a presently preferred embodiment of the invention is illustrated by way of example. It is to be expressly understood, however, that the drawing is for the purpose of illustration and description only, and is not intended as a definition of the limits of the invention.

DESCRIPTION OF THE PRESENTLY PREFERRED EMBODIMENT

Figure 1:
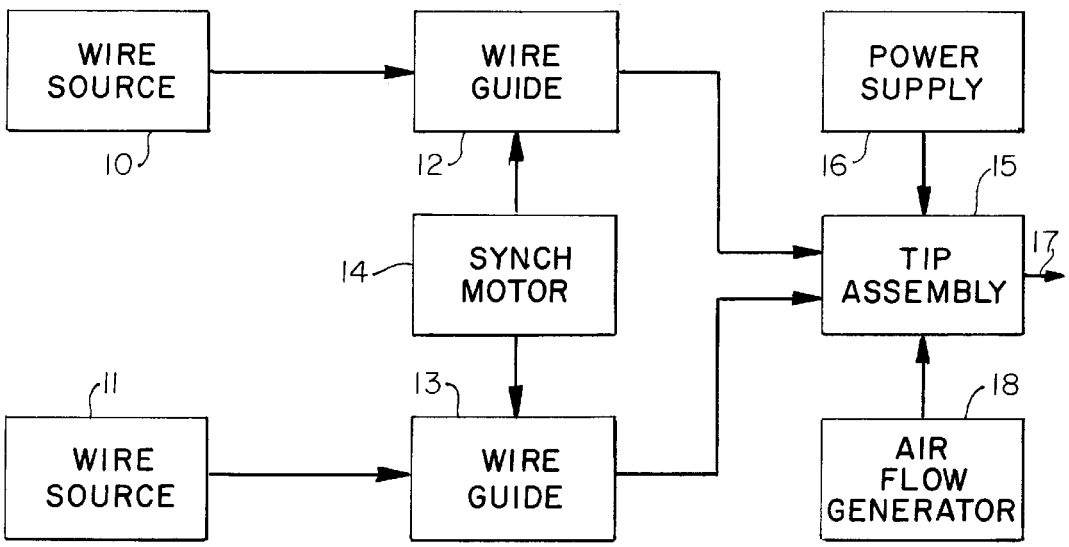
FIG. 1 provides a schematic block diagram of the present invention spark generating apparatus.

An understanding of the present invention may be best gained by reference to FIG. 1 wherein a schematic block diagram of the invention is illustrated. The present invention comprises an apparatus which is intended to utilize sources of coiled wire to generate sparks for theatrical, special effects. As shown in FIG. 1, wire sources 10 and 11 each comprise extended source of cylindrical wire having a diameter in the range of 0.020–0.125 inches. Wire being dispensed from wire sources 10 and 11 are input to wire guides 12 and 13, respectively. Wire guides 12 and 13 impart linear movement to the wire sources through the use of synchronizing motor 14. The output of wire guides 12 and 13 are coupled to tip assembly 15 which will be explained in detail hereinbelow. As stated hereinabove, an objective of the present invention is to provide a spark generator which can be operated in remote locations. The amplified output of a direct current power source 16 is coupled to tip assembly 15 and placed adjacent interface 17 at which the wire sources are placed in abutment with one another. A variable air flow generator 18 is coupled to tip assembly 15 in a manner which will permit the selective dissemination of atomized metallic particles in accordance with the present invention.

Figure 2:
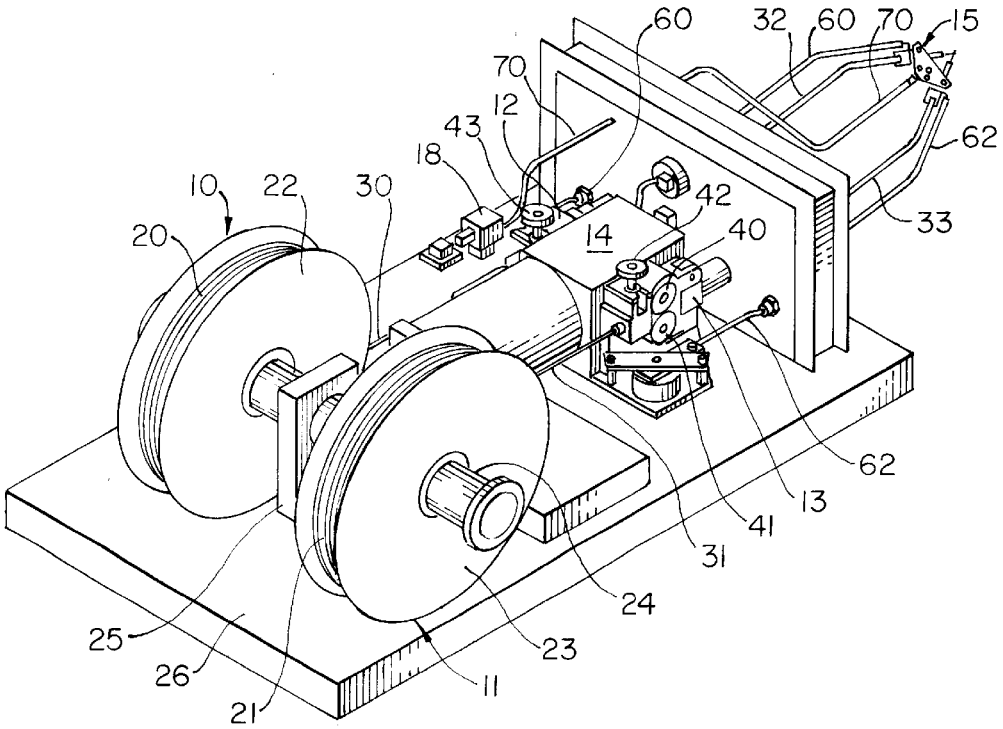
FIG. 2 illustrates a perspective view of the present invention spark generating apparatus illustrating a pair of wire source supply reels.

As can be best seen in FIG. 2, individual coils of metallic wire 20 and 21 are mounted upon feed reels 22 and 23, respectively. Each of the feed reels 22 and 23 are journeled about shaft 24 which is secured by flange 25 in parallel, spaced relation to a base panel 26. A wire strand 30 extending from wire coil 20 is coupled through wire guide 13. In a like manner, wire strand 31 extends from wire coil 21 and is coupled to wire guide 13. As will be described in detail hereinbelow, the output of wire guides 12 and 13 are routed through wire conduits 32 and 33 respectively, and coupled to tip assembly 15.

Each of the wire guides 12 and 13 is a conventional device which is used to provide longitudinal motion to a wire strand. As can be best seen in FIG. 2, wire guide 13 includes a pair of cylindrical roller guides 40 and 41 which are journeled about the respective axis, wire strand 31 extending between roller guides 40 and 41. Each of the wire guides 12 and 13 are rotatably powered by synchronous motor 14 to impart linear movement to wire strands 30 and 31, respectively. The contact between roller guides 40 and 41 on wire strand 31 is determined by pressure adjustment control 42. In a like manner, pressure adjustment control 43 sets the coupling force between wire guide 12 and wire strand 30. Synchronizing motor 14 is coupled to roller guides 40 and 41 to provide linear movement to wire strand 31. In a like manner, synchronous motor 14 is coupled to wire guide 12 and synchronizes the linear movement of wire strand 30 to that of wire strand 31.

Figure 3:
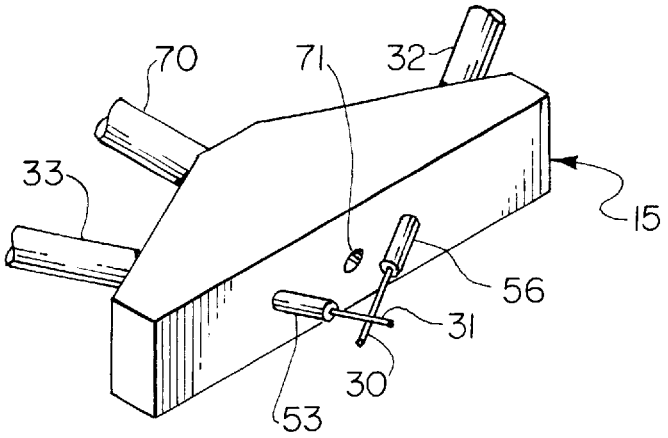
FIG. 3 is a perspective view of the tip assembly shown in FIG. 2 and the interface between the preatomized wire sources.
Figure 4:
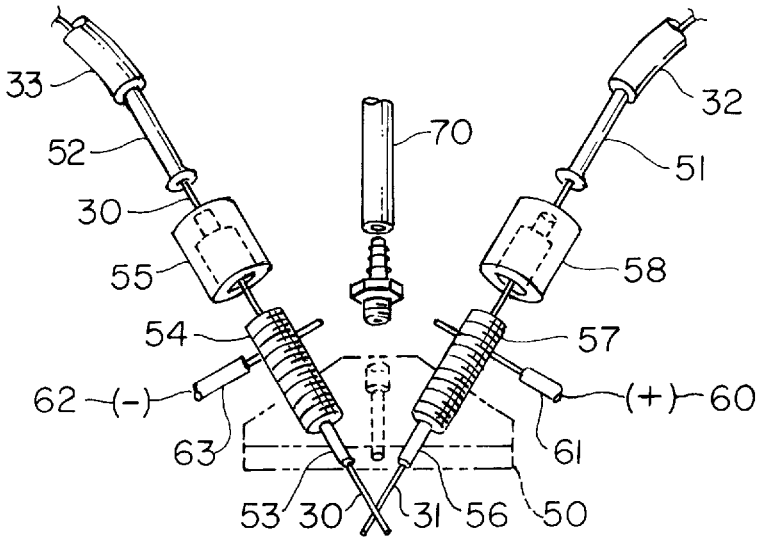
FIG. 4 illustrates an assembly view of the tip assembly shown in FIG. 3.

As stated hereinabove, the present invention generates sparks by atomizing wire strands 30 and 31. The manner in which the sparks are generated can be best understood by reference to FIG. 3 and FIG. 4. As can be seen in FIG. 3, tip assembly 15 is constructed of a non-conducting fiber block 50 through which wire strands 30 and 31 are coupled. Wire conduit 32 and 33 each consist of an internal flexible guide channel 51 and 52, respectively. Wire strand 30 is fed through flexible guide channel 52 and extends from non-conducting fiber block 50 through a cylindrical, conducting feed tip 53. Feed tip 53 is coupled to flexible guide channel 52 by a conventional conducting stud 54 and mating conduit nut 55. In a like manner, wire strand 30 is extended from conducting feed tip 56 which is coupled to conduit 32 by conducting stud 57 and a mating conduit nut 58.

The present invention utilizes a conventional, amplified direct current power supply 16 to generate sparks. As can be best seen in FIG. 4, positive anode 60 is electrically coupled to feed tip 56 by being disposed about conducting stud 57 and clamped between conduit nut 58 and non-conducting fiber block 50. In a like manner, negative electrode 62 is electrically connected to feed tip 53 by having lugs 63 disposed about conducting stud 54 and being secured between conduit nut 55 and non-conducting fiber block 50.

In order to atomize wire strands 30 and 31, the output of direct current power source is typically connected to a conventional converter which will provide high voltage, high current spikes for short time intervals. As can be seen in FIG. 3, feed tips 53 and 56 cause wire strands 30 and 31 to be placed adjacent one another thereby creating a short circuit across positive and negative electrodes 60 and 62. By short circuiting the output of the power supply, wire strands 30 and 31 will be atomized into particles which create visual sparks. Depending upon the metal selected for wire strands 30 and 31 and the linear speed imposed by wire guides 12 and 13, the magnitude of generated sparks may be altered.

As stated, it is an objective of the present invention to provide the capability of disseminating generated sparks over a selected area. To meet this objective, air flow generator 18 provides a source of compressed air through conduit 70. The pressurized air flowing through conduit 70 is emitted from aperture 71 which is located adjacent the location where wire strands 30 and 31 are adjacent one another. The flow of air through aperture 71 may be varied through conventional means (e.g., raising or lowering pressure). When air is flowing through aperture 71, atomized particles from wire strands 30 and 31 may be propelled up to 40 feet from tip assembly 15.

It can therefore be seen the present invention provides an improved apparatus for generating sparks to be used for theatrical special effects. By using a pair of wire sources which are synchronously moved in relation to one another, a continuous source of conductive material is provided. By applying the converted and amplified output of a direct current power source to the wire sources, atomized particles of metal will be produced when the wire sources are brought sufficiently adjacent one another to short circuit the power supply. Furthermore, by adjusting the output of an adjacent air flow generators, sparks will be disseminated over a predetermined area.

I claim:

1. A spark generating apparatus comprising:

(a) metal source means for providing at least two independent sources of cylindrical, metal wire;

(b) first and second wire guides each having an input and an output, the input of each of said first and second wire guides being adapted to be coupled to one of the sources of metal wire;

(c) motive means coupled to said first and second wire guides for imparting synchronous, linear movement to the wire from the input to the output of said wire guides;

(d) a non-conducting member having a pair of obliquely oriented, cylindrical apertures disposed therethrough;

(e) first and second conductive feed tips having first and second ends, each of said first and second conductive feed tips mounted within one of the apertures of said non-conductive member, the first ends of said first and second feed tips being coupled to the output of said first and second wire guides, respectively;

(f) power source means for atomizing the metal wire being coupled to said first and second feed tips; and (g) air flow means for providing a directed stream of air being coupled to said non-conductive member adjacent the second ends of said first and second feed tips.

2. A spark generating apparatus as defined in claim 1 wherein said metal source means comprises a planar base member, a cylindrical shaft coupled to said base member and being in parallel spaced relation thereto, and a pair of cylindrical wheels journeled about said shaft in spaced relation from each other, each of said cylindrical reels adapted to provide a source of cylindrical, metal wire.

3. A spark generating apparatus as defined in claim 1 wherein said power source means comprises a direct current power source and means for amplifying the current and voltage output thereof.

4. A spark generating apparatus as defined in claim 1 wherein the axis of said first and second conductive feed tip intersects substantially adjacent the second ends thereof whereby sources of metal wire being disposed therethrough be placed adjacent one another.

5. A spark generating apparatus for atomizing metal wire comprising:

(a) a planar base member;

(b) a cylindrical shaft coupled to said base member and being in parallel spaced relation thereto;

(c) first and second cylindrical wheels journeled about said shaft in spaced relation to each other, each of said cylindrical wheels being adapted to provide a source of cylindrical, metal wire;

(d) first and second wire guides each having an input and an output, the input of said first and second wire guides being adapted to be coupled to said first and second cylindrical wheels respectively;

(e) motive means coupled to said first and second wire guides for imparting synchronous, linear movement to the wire from the input to the output of said wire guides;

(f) a non-conducting member having a pair of obliquely oriented, cylindrical apertures disposed therethrough;

(g) first and second conductive feed tips having first and second ends, each of said first and second conductive feed tips mounted within one of the apertures of said non-conductive member, the first ends of said first and second feed tips being coupled to the output of said first and second wire guides, respectively;

(h) power source means for atomizing the metal wire being coupled to said first and second feed tips; and (i) air flow means for providing a directed stream of air being coupled to said non-conductive member adjacent the second ends of said first and second feed tips.

6. A spark generating apparatus as defined in claim 5 wherein said power source means comprises a direct current power source and means for amplifying the current and voltage output thereof.

7. A spark generating apparatus as defined in claim 5 wherein the axis of said first and second conductive feed tip intersects substantially adjacent the second ends thereof whereby sources of metal wire being disposed therethrough be placed adjacent one another.

* * * * *